US008070558B2

(12) United States Patent
Young

(10) Patent No.: US 8,070,558 B2
(45) Date of Patent: Dec. 6, 2011

(54) PORCELAIN EPOXY FLOORING AND METHOD FOR PRODUCING THE SAME

(76) Inventor: David Young, Martinsville, IN (US)

( * ) Notice: Subject to any disclaimer, the term of this patent is extended or adjusted under 35 U.S.C. 154(b) by 202 days.

(21) Appl. No.: 12/474,266

(22) Filed: May 28, 2009

(65) Prior Publication Data

US 2010/0223874 A1 Sep. 9, 2010

Related U.S. Application Data

(60) Provisional application No. 61/157,449, filed on Mar. 4, 2009.

(51) Int. Cl.
*B24B 7/22* (2006.01)

(52) U.S. Cl. ..... 451/57; 451/41; 125/3

(58) Field of Classification Search ..... 451/353, 451/350, 359, 57, 41; 125/3, 38, 25
See application file for complete search history.

(56) References Cited

U.S. PATENT DOCUMENTS 3,146,559 A * 9/1964 Wilkinson ..... 451/353
3,934,377 A * 1/1976 Tertinek ..... 451/353
5,203,122 A * 4/1993 Campbell ..... 451/53
5,454,751 A * 10/1995 Wiand ..... 451/526
5,514,027 A * 5/1996 Pearlman ..... 451/353

* cited by examiner

*Primary Examiner* — Robert Rose
(74) *Attorney, Agent, or Firm* — C. John Brannon

(57) ABSTRACT

An epoxy porcelain tile surface including a plurality of spaced, substantially flat substantially smooth porcelain tiles and epoxy grouting substantially filling the spaces between the porcelain tiles. The plurality of spaced, substantially flat substantially smooth porcelain tiles are substantially flush with one another and substantially flush with the epoxy grouting.

8 Claims, 14 Drawing Sheets

PORCELAIN EPOXY FLOORING AND METHOD FOR PRODUCING THE SAME

CROSS-REFERENCE TO RELATED APPLICATIONS

This application claims priority to co-pending U.S. Provisional Patent Application Ser. No. 61/157,449, filed Mar. 4, 2009.

TECHNICAL FIELD OF THE INVENTION

The invention relates generally to the field of tile flooring and, specifically, to an epoxy-grouted porcelain tile surface and a method for producing the same.

BACKGROUND OF THE INVENTION

Terrazzo surfaces are characterized by exposed marble or other aggregate chips or pieces set in a cementitious, polymer or resin matrices and are used for flooring, paneling and countertopping. Traditional marble-chip, cementitious terrazzo requires three layers of materials, i.e., a concrete foundation (typically 3 to 4 inches deep), a 2 to 3 inch deep mudbed, a relatively thin layer of sandy concrete or the like laid over the mudbed and having partially embed metal divider strips positioned therein to define joints and/or color patterns, and a fine marble chip mixture of desired colors applied into the concrete to define a terrazzo pattern. Before the layered cementitious materials set, additional marble chips of various colors may be sprinkled onto the surface. A lightweight roller is rolled over the entire surface and the material is then allowed to cure to yield a rough terrazzo surface. After curing, the rough surface is ground and then polished and sealed to prevent incursion of water and/or biohazardous material into the porosity inherent in the marble aggregate and cement matrix. The polishing and sealing processes must be repeated periodically, as terrazzo surfaces are worn down by foot traffic and the like, and even the grinding process may require repetition from time to time as damage from wear and tear dictates.

Recently, polymer-based terrazzo have become popular. Typically, the matrix material is epoxy resin, although materials, such as polyester and vinyl ester resins, may be used as the binder material. Resinous grouting has several advantages over cement grouting, such as wider color selection, thinner installation thickness, lighter weight, faster installation, impermeable finish, higher strength, and less susceptibility to cracking.

As with cementitious terrazzo, after curing, resin grouted terrazzo surfaces 10 are ground with a terrazzo grinder 12, which is roughly similar to a floor polisher, but substantially heavier. Depressions 14 left by the grinding operations are typically either ground and polished out or filled with a matching grout material and hand troweled for a smooth, uniform surface, which is then cleaned, polished, and sealed. As with traditional cementitious terrazzo, the epoxy-marble terrazzo surfaces 10 require periodic stripping, polishing and resealing due to wear. Marble and granite aggregate pieces have not been replaced with other, less porous, material such as porcelain tiles since porcelain tiles cannot be laid flat into a cementitious foundation and cannot be ground and polished flat like marble or granite, since running a heavy terrazzo grinder 12 over porcelain tiles will generate cracks in the tiles and snap off corners and edges. Further, since porcelain tiles are substantially harder than even granite, grinding the porcelain tiles down to yield a flat, terrazzo-like surface is physically difficult and economically unfeasable, as the wear on the diamond abrasives 16 would be substantially greater than for marble terrazzo and the grinding time would be substantially longer, not only substantially increasing the abrasive costs but also generating even more damage to the tiles themselves from the extended residence time of the grinder on the tiles. Thus, a need remains for a terrazzo or terrazzo-like flooring and/or surface that is inherently impermeable, that is substantially flat and smooth, and that does not require periodic maintenance. The present invention addresses this need.

SUMMARY OF THE INVENTION

The present invention relates to an improved terrazzo or terrazzo-like flooring and surfacing material and an improved method for producing and finishing the same. One object of the present invention is to provide an improved terrazzo material. Related objects and advantages of the present invention will be apparent from the following description.

DESCRIPTION OF THE PREFERRED EMBODIMENTS

Figure 1A:
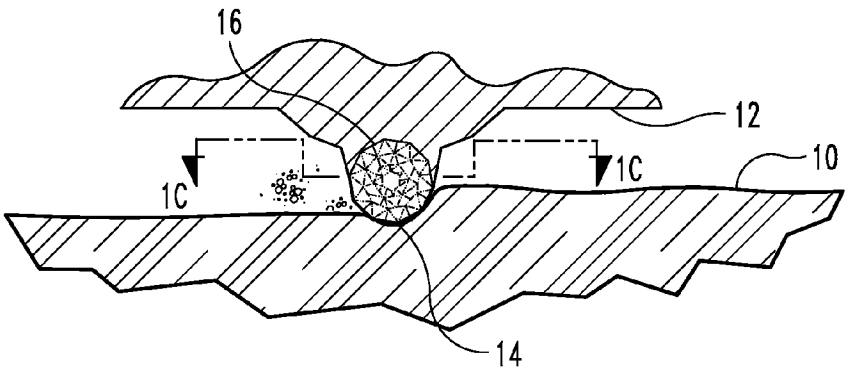
Fig. 1A (Prior Art)
FIG. 1A is a side schematic view of an abrasive crystal grinding a workpiece according to the prior art.
Figure 1B:
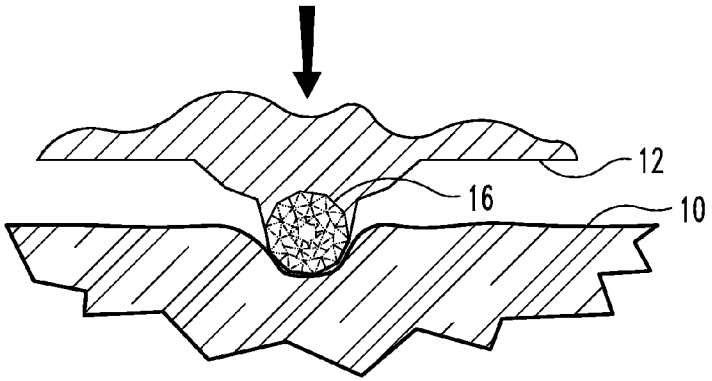
Fig. 1B (Prior Art)
FIG. 1B is a front schematic view of FIG. 1A.
Figure 1C:
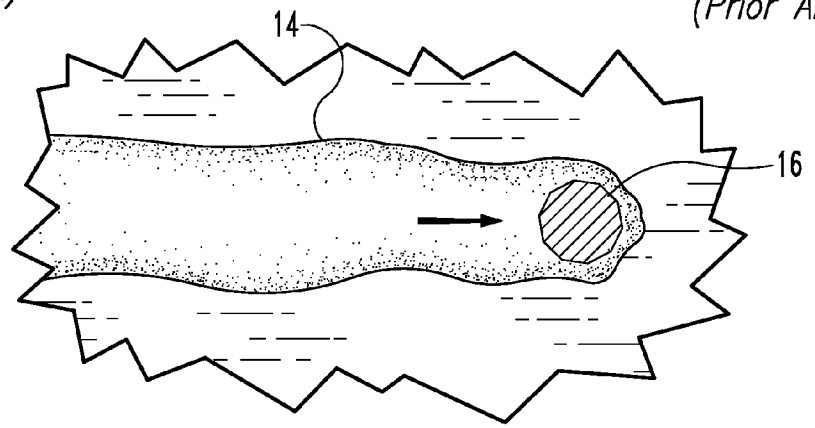
Fig. 1C (Prior Art)
FIG. 1C is a top schematic view of FIG. 1A.
Figure 2:
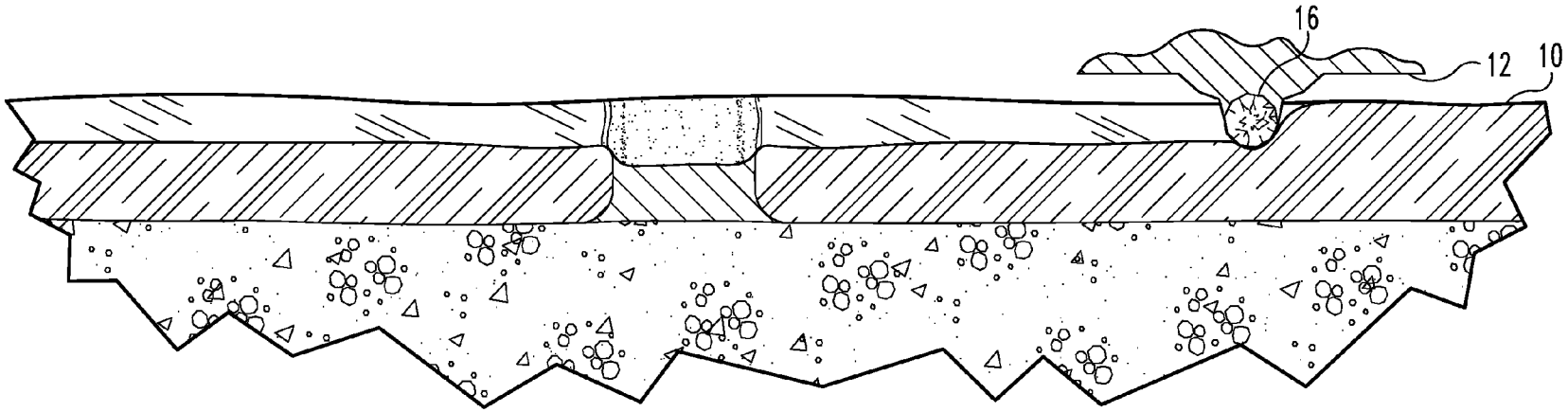
Fig. 2 (Prior Art)
FIG. 2 is a side schematic view of an abrasive crystal grinding a marble chips and epoxy matrix material defining epoxy terrazzo according to the prior art.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

Background of Diamond Abrasive Grinding Tools and Techniques

The grinding and polishing of stone surfaces, such as granite or marble, is typically accomplished through the use of super abrasive media, such as diamond or cubic boron nitride tools. Typically, diamond tools are preferred for non-ferrous workpieces. Diamond abrasive tools for working stone and the like are typically made from mesh diamond particles embedded in a matrix material. These mesh diamond tools may be sorted into three general classes: resin vitreous grinding (RVG) diamond, metal bond grinding diamond (MBG) and metal bond saw diamond (MBS). (RVG, MBG and MBS are registered trademarks of Diamond Innovations, Inc., a Delaware Corporation, 6325 Huntley Road, Worthington, Ohio, 43229.) While other companies may have other names or designations for their mesh diamonds, the RVG, MBG and MBS designations were instituted by diamond technology leader GE Super Abrasives, now Diamond Innovations, and are well understood in the industry and will be used herein to describe a general class of diamond abrasive tools, not just those from any one vendor. Each class includes a range of different products, the typical characteristic of which are generally described below.

RVG diamond crystals are typically used in a resinous or vitreous bond system for grinding purposes. RVG diamond particles are typically elongated and irregular in shape and have numerous rough edges. These characteristics give rise to especially good bond retention of the RVG particles. RVG product is often metal-coated to further enhance bond retention as well as to aid in dissipation of heat generated during a grinding operation.

RVG crystals are grown rapidly and thus tend to be polycrystalline and also tend to have a high concentration of metallic and graphitic inclusions, resulting in very friable particles. While RVG, MBG, and MBS diamond crystals are all still essentially of the same hardness, the polycrystalline and heavily included nature of RVG particles render them more easily fractured than typical MBG and MBS crystals. Further, RVG particles fracture with a brittle mode, displaying numerous sharp edges. Thus, RVG crystals wear by a brittle fracture mechanism and constantly generate new sharp edges for attacking the workpiece. This mechanism is in contrast to how tougher diamond crystals, such as natural mined diamonds, wear by becoming dull and rounded and thus less efficient as grinding media. RVG diamond is typically used for wet grinding cemented tungsten carbide (when nickel coated) and for dry grinding carbon steel workpieces (when copper coated).

MBG particles are typically single diamond crystals and have regular, blocky shapes. Typically, MBG crystals are cubo-octohedral and have triangular and/or hexagonal facets. MBG crystals are typically used in metal bond systems and the most commonly selected metal bond matrix material is cobalt, although other cobalt alloys and non-cobalt metals may also be suitable matrices. MBG diamond abrasive tools are typically used for grinding such materials as cemented carbides, alumina, glass and like materials. MGB diamond crystals are more regular in shape and less included than RVG crystals, and as such are tougher. While they still are prone to fracture, the fracture surfaces are less extreme in shape than those of RVG crystals. As toughness increases, the fracture mode tends to move toward crystal edge splintering, yielding relatively large fragments and fewer small, rough irregular pieces. The fracture mode of MBG crystals begins to favor edge splintering over the more friable mechanism described above, with one end of the MBG product spectrum wearing more like typical RVG products and the other end wearing more like typical MBS products.

MBS crystals are likewise cubo-octahedral in shape and are even less included than MBG crystals, with the inclusions being almost exclusively graphitic. MBS crystals are thus the toughest of the three classes and least prone to friable fracture and wear almost exclusively by the edge splintering mechanism. MBS crystals are typically used for cutting operations, such as in saw blades for cutting through steel reinforced concrete granite, marble, porcelain and the like, as well as in heads and bits for drilling and mining operations.

Grinding with diamond media is typically accomplished through an impact mechanism, wherein the diamond abrasive particle plows and chips its way through the workpiece. Under these conditions, tougher crystals tend to become rounded rather than fracture and thus lose their ability to efficiently grind. Workpiece material may also be removed by a spalling mechanism, wherein the abrasive crystals compressively load protrusions in the workpiece, which microcrack and spall apart when the load is suddenly removed. The spalling mechanism is less sensitive to abrasive crystals becoming blunt, but still requires the crystals to substantially protrude from the bond material.

More friable crystals fracture at a predictable, controlled rate and thus remain fresh for grinding the workpiece. The choice of RVG or MBG type abrasives is function of workpiece toughness. For example, granite is too tough to be efficiently ground by friable RVG materials and so MBG diamonds are preferred. Likewise, for many finishing applications, the RVG bond matrix is too soft, wearing away too fast and thus wasting the grinding potential of the abrasives therein. For marble terrazzo applications, marble is effectively soft enough for RVG tools to be effectively used and, since RVG tools are less expensive than MBG tools, RVG tools are often opted for over MBG.

Traditional Terrazzo Surface Finishing Techniques:

Terrazzo surfaces, typically floors, are finished by first grinding down the aggregate and grouting to define a generally even, level surface and then polishing the ground surface to produce a smooth finish generally free of scratches and cuts. A surface is generally considered smooth when polished to a 120-grit finish, although progressively smaller grits, such as 300, 400 and/or 800, may be used to yield progressively smoother surfaces. The polished surface is then typically chemically vitrified or, alternately, sealed, such as with a varnish, polymer or like compound, to prevent encroachment of moisture, which can degrade the marble aggregate and cementitious grouting through thermal cycling (cyclical refreezing, wherein water expands against the contracting pores in which it is trapped) as well as provide a medium for bacterial growth.

Grinding is typically accomplished with a terrazzo grinder, a rotary grinding device that resembles a conventional floor polisher, but with diamond or like hard abrasive heads rotatably connected thereto for contact with the to-be-ground floor surface. The motor driving the rotatable grinding heads is substantially more powerful than that of a floor polisher, and the terrazzo grinder is also substantially heavier, weighing as much as 500 pounds or more.

Typically, the coarsest grinding/polishing diamond heads include 24- to 36-grit diamonds incased in a metal bond, with subsequent grinding and polishing abrasive media becoming progressively finer. Typically, the floor is ground first with the larger media and then with successively smaller, higher-grit media until a relatively smooth and even surface is achieved. After polishing, the surface is chemically sealed to eliminate open porosity. As traffic results in wear on the floor surface, the grinding/polishing/sealing treatment must be periodically repeated to keep the floor looking good as well as to maintain a substantially non-porous surface for wear reduction as well as for sanitary reasons.

Figure 3:
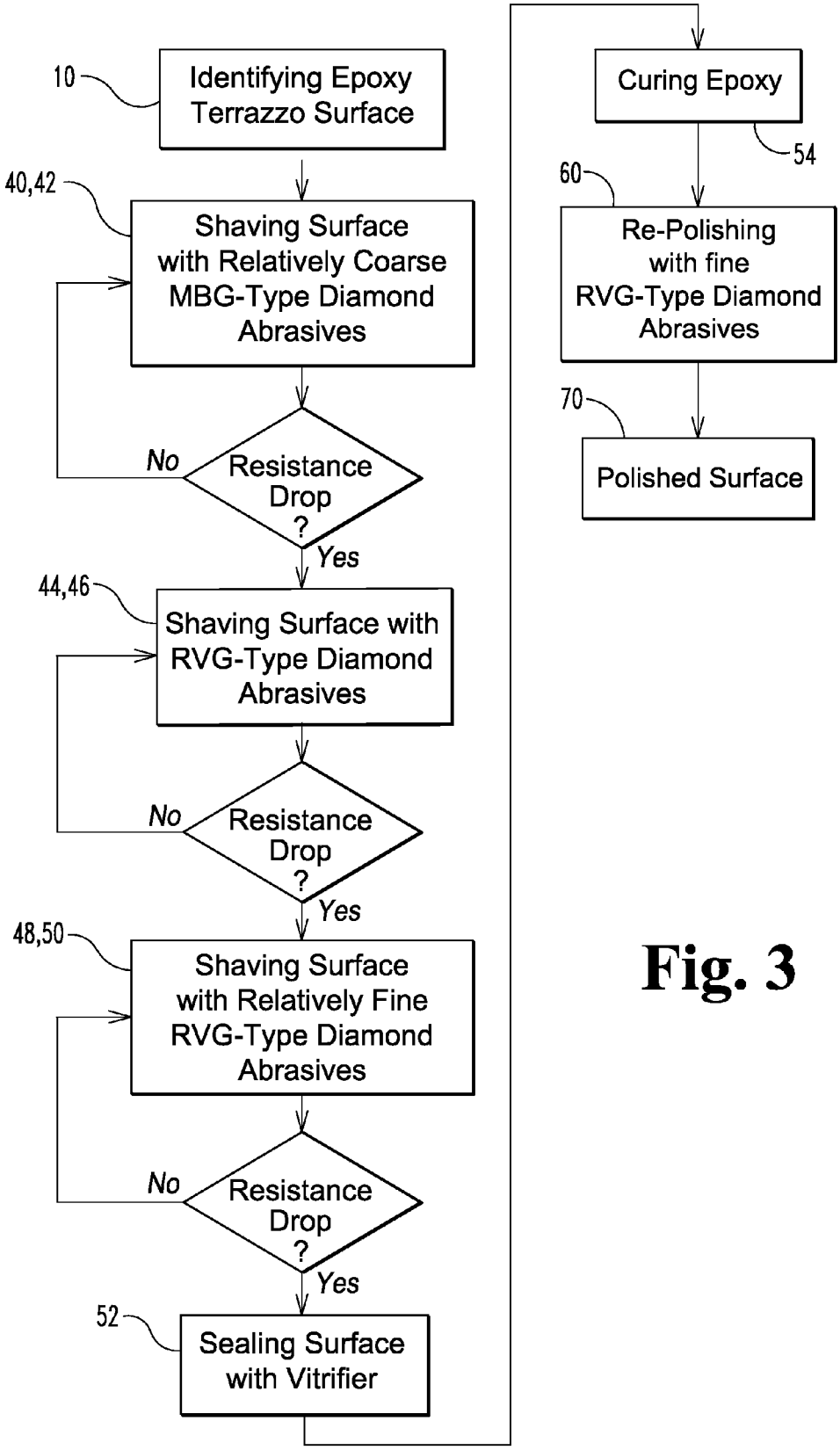
FIG. 3 graphically illustrates a first embodiment terrazzo floor polishing method according to a first embodiment of the present novel technology
Figure 4B:
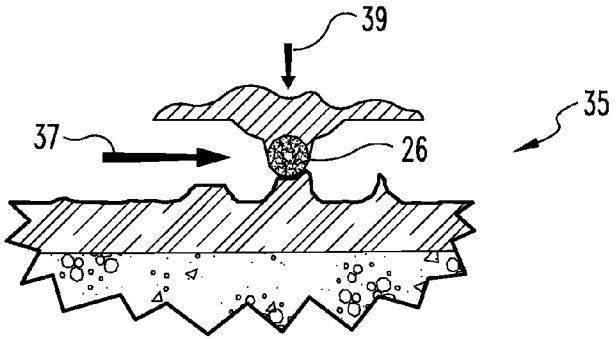
FIG. 4B is a second schematic view of an abrasive crystal grinding a workpiece according to the embodiment of FIG. 3.
Figure 4A:
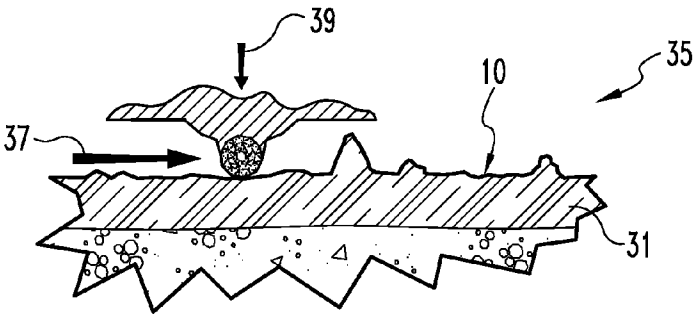
FIG. 4A is a first side schematic view of an abrasive crystal grinding a workpiece according to the embodiment of FIG. 3.
Figure 4C:
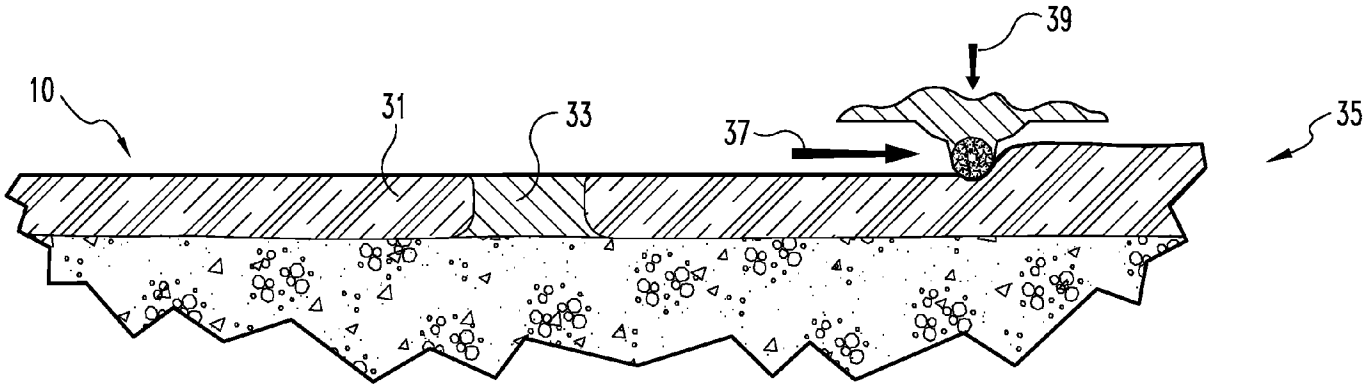
FIG. 4C is a third schematic view of an abrasive crystal grinding a workpiece according to the embodiment of FIG. 3.
Figure 5D:
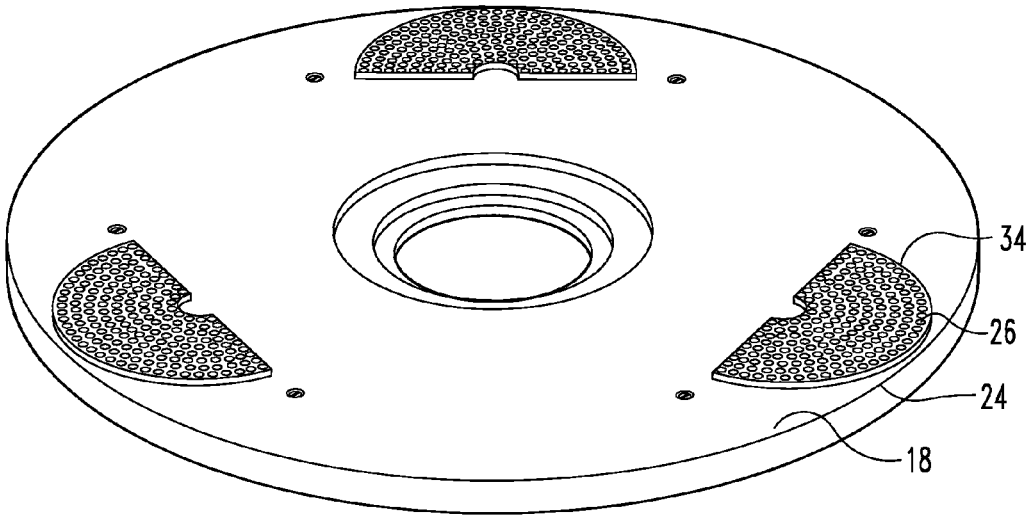
FIG. 5D is a perspective view of the high-density foam circular drive board with ceramic bond abrasive discs having medium grit abrasives symmetrically oriented thereupon.
Figure 5A:
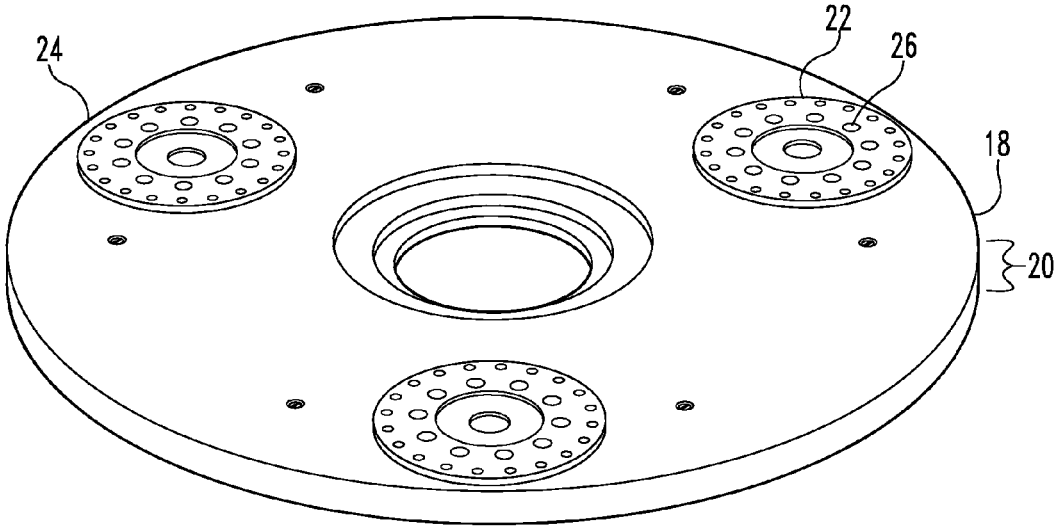
FIG. 5A is a perspective view of a high-density foam circular drive board with metal bond abrasive discs having coarse grit abrasives symmetrically oriented thereupon according to the embodiment of FIG. 3.
Figures 5B, 5E, 5H:
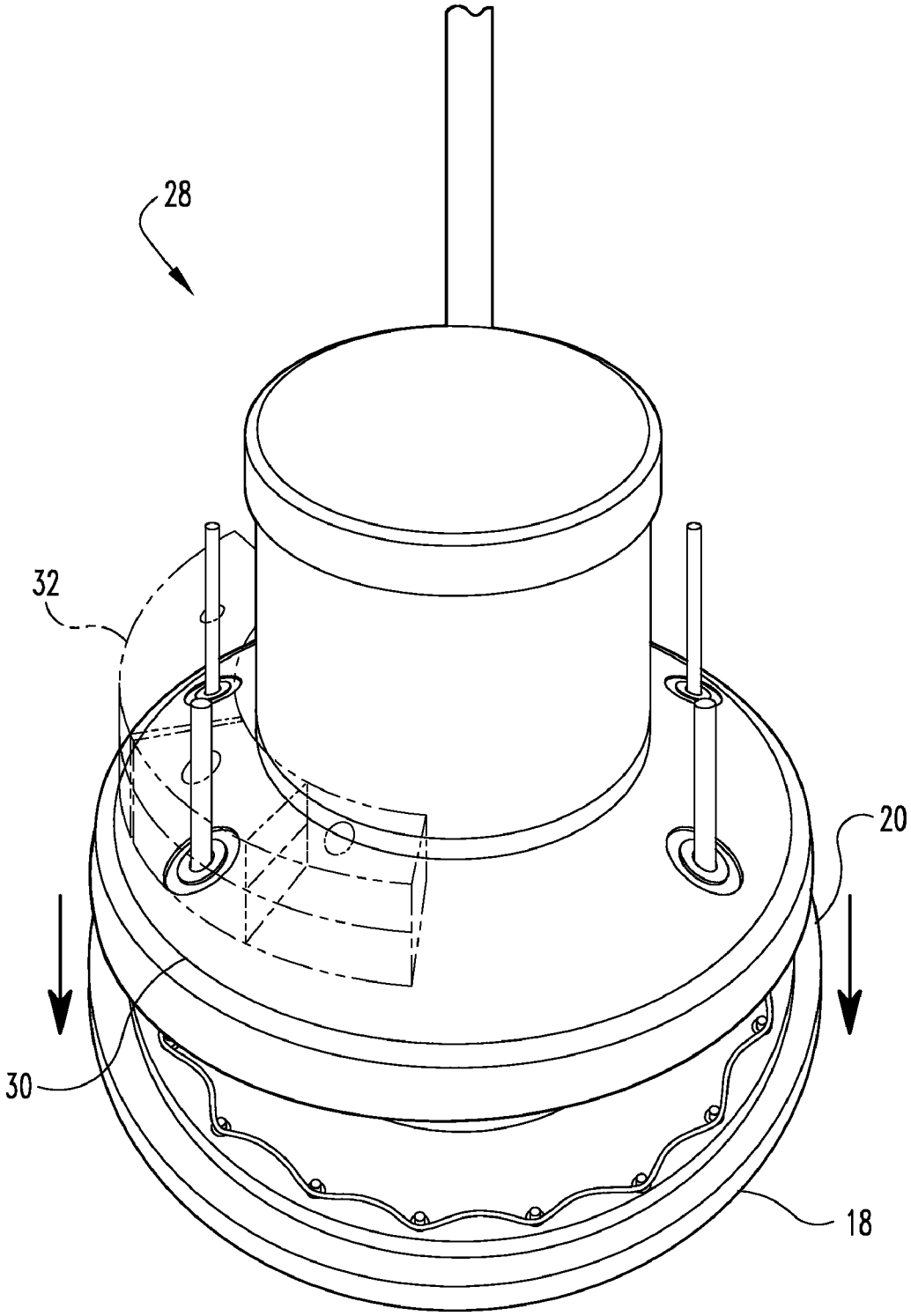
FIG. 5B is a perspective view of the circular drive board of FIG. 5A engaging to a polishing machine.
FIG. 5E is a perspective view of the circular drive board of FIG. 5D engaging to a polishing machine.
FIG. 5H is a perspective view of the circular drive board of FIG. 5G engaging to a polishing machine.
Figure 5C:
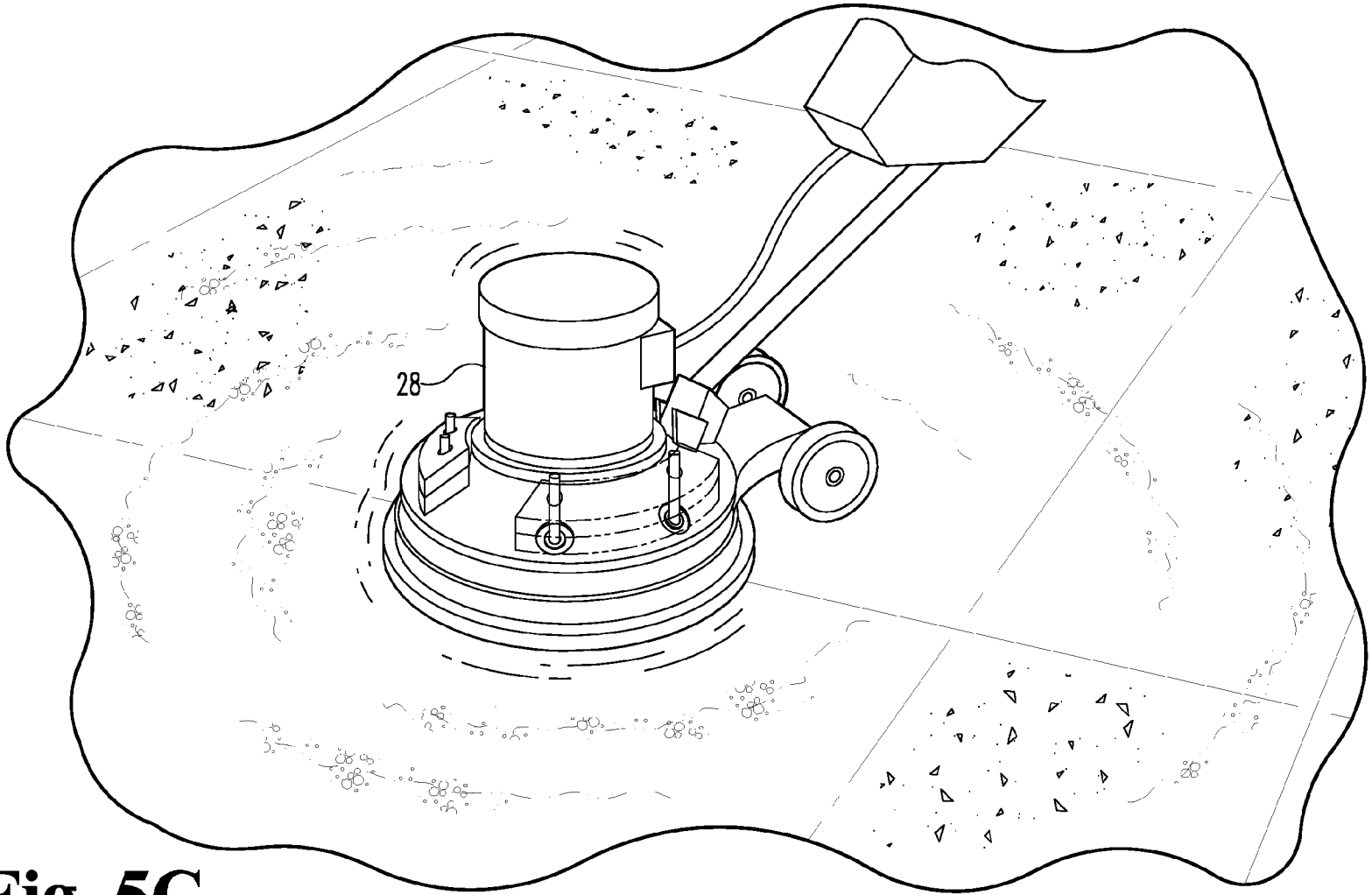
FIG. 5C is a perspective view of the polishing machine of FIG. 5B shaving an epoxy terrazzo floor with coarse grit abrasives.
Figure 5F:
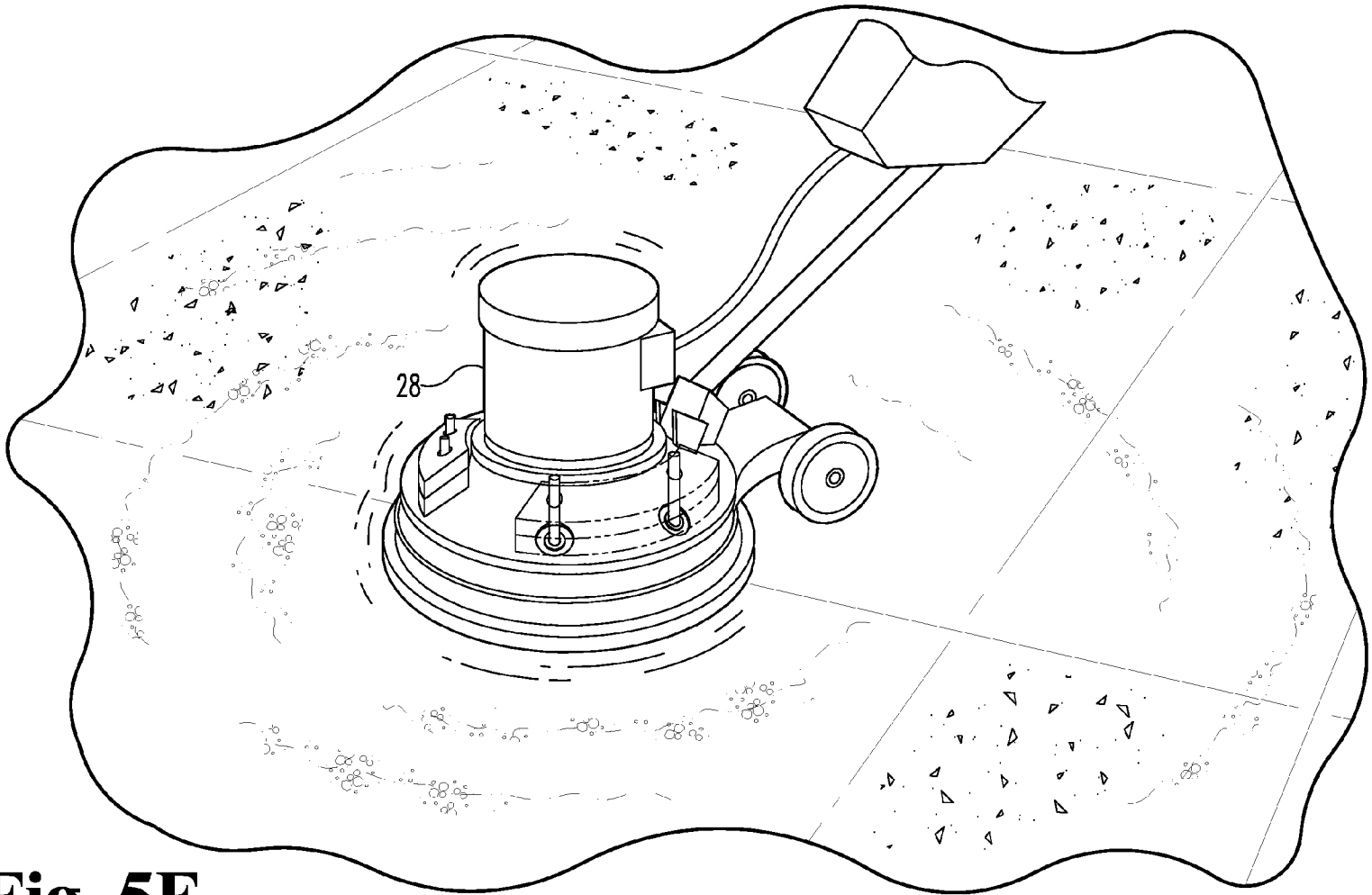
FIG. 5F is a perspective view of the polishing machine of FIG. 5E shaving an epoxy terrazzo floor with medium grit abrasives.
Figure 5G:
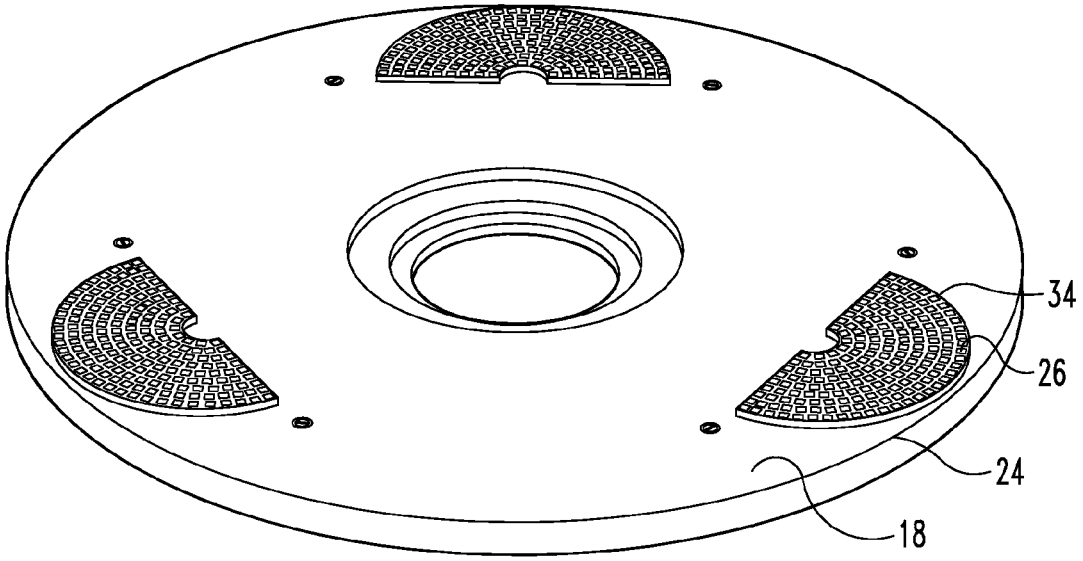
FIG. 5G is a perspective view of the high-density foam circular drive board with ceramic bond abrasive discs having fine grit abrasives symmetrically oriented thereupon.
Figure 5I:
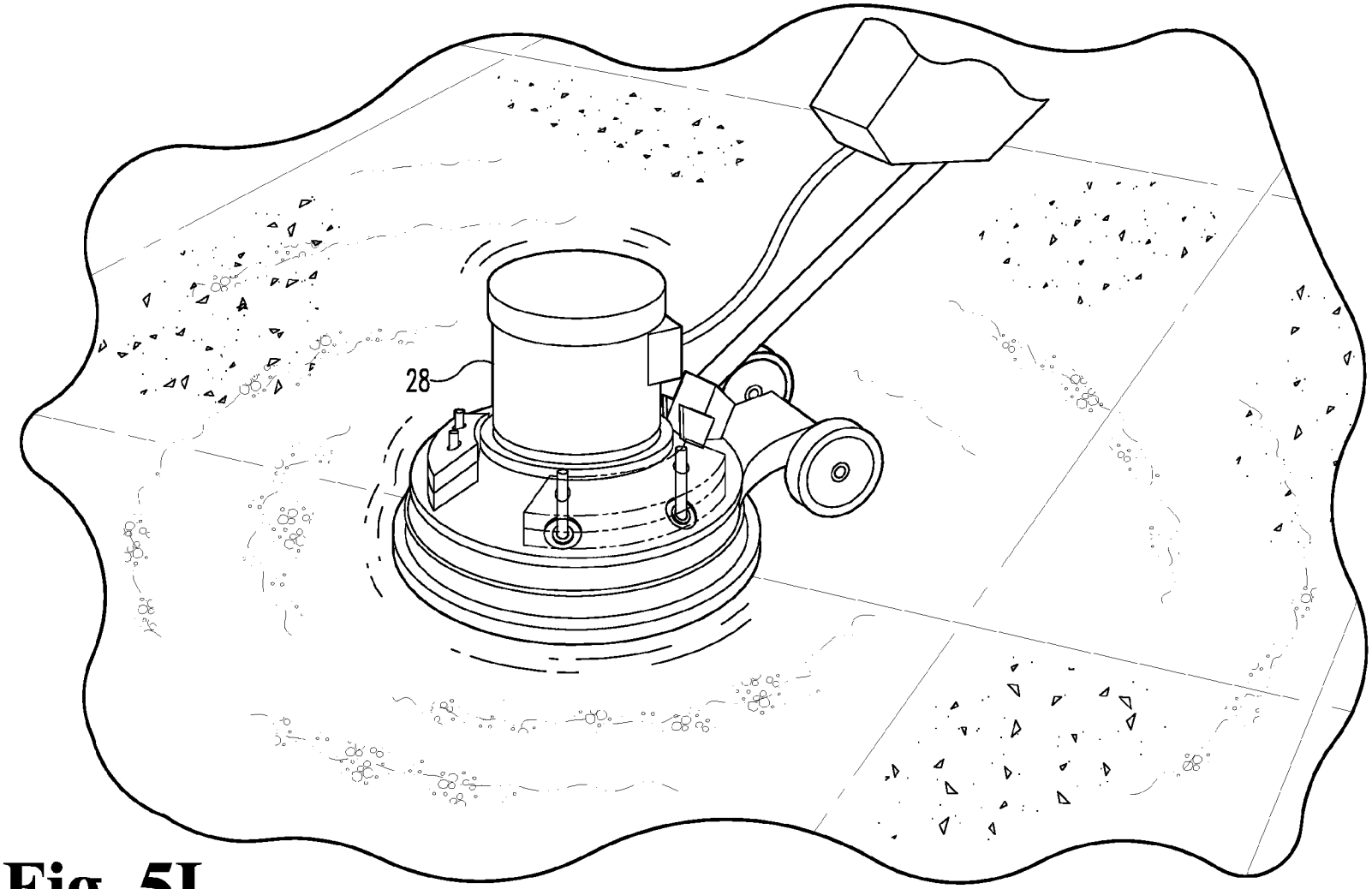
FIG. 5I is a perspective view of the polishing machine of FIG. 5H shaving an epoxy terrazzo floor with fine grit abrasives.
Figure 5J:
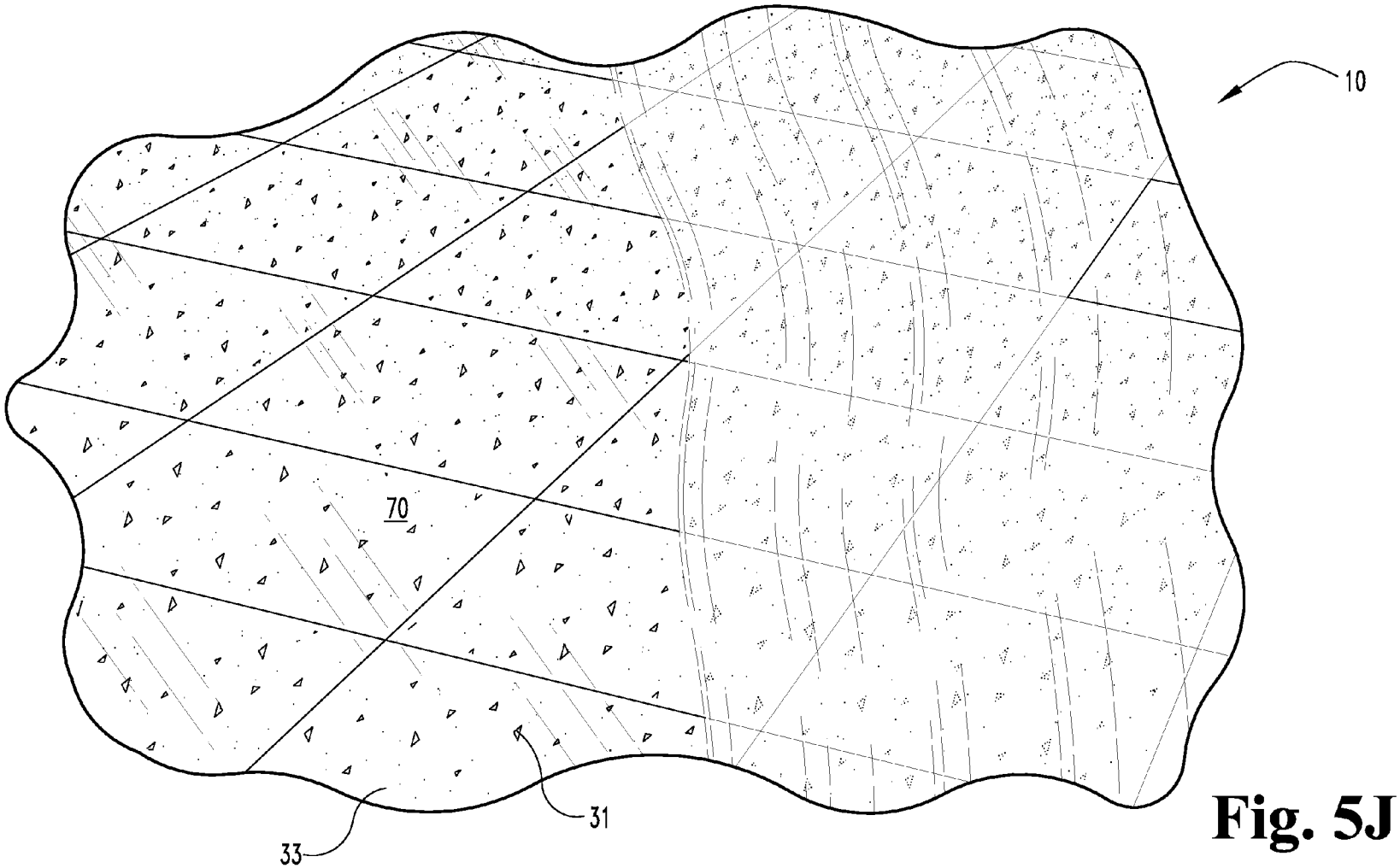
FIG. 5J is a perspective view of the floor of FIG. 5I.
Figure 5K:
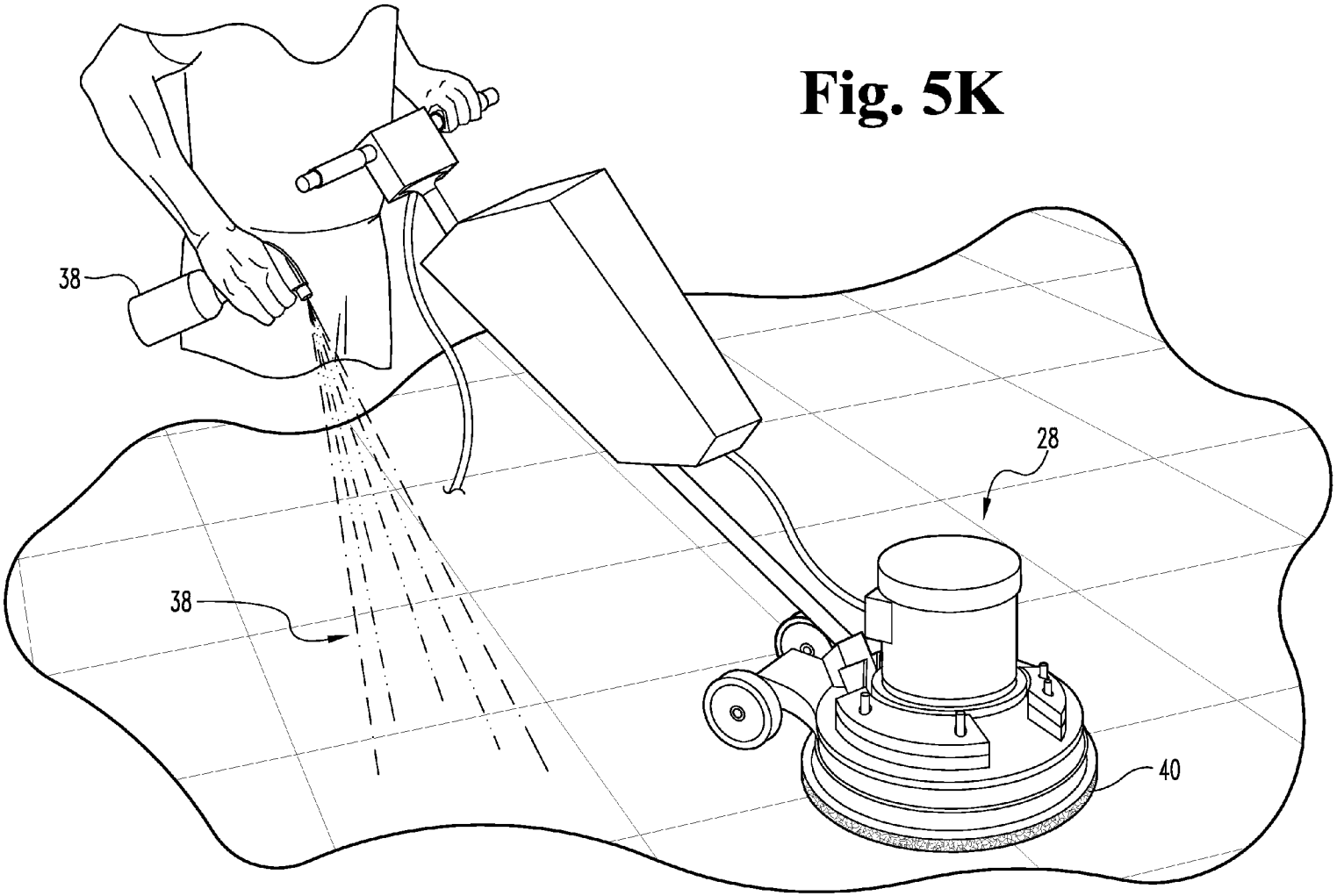
FIG. 5K is a perspective view of the floor of FIG. 5J being vitrified via a final polish with a steel wool pad and a simultaneous application of a magnesium fluoride vitrification chemical.
Figure 6A:
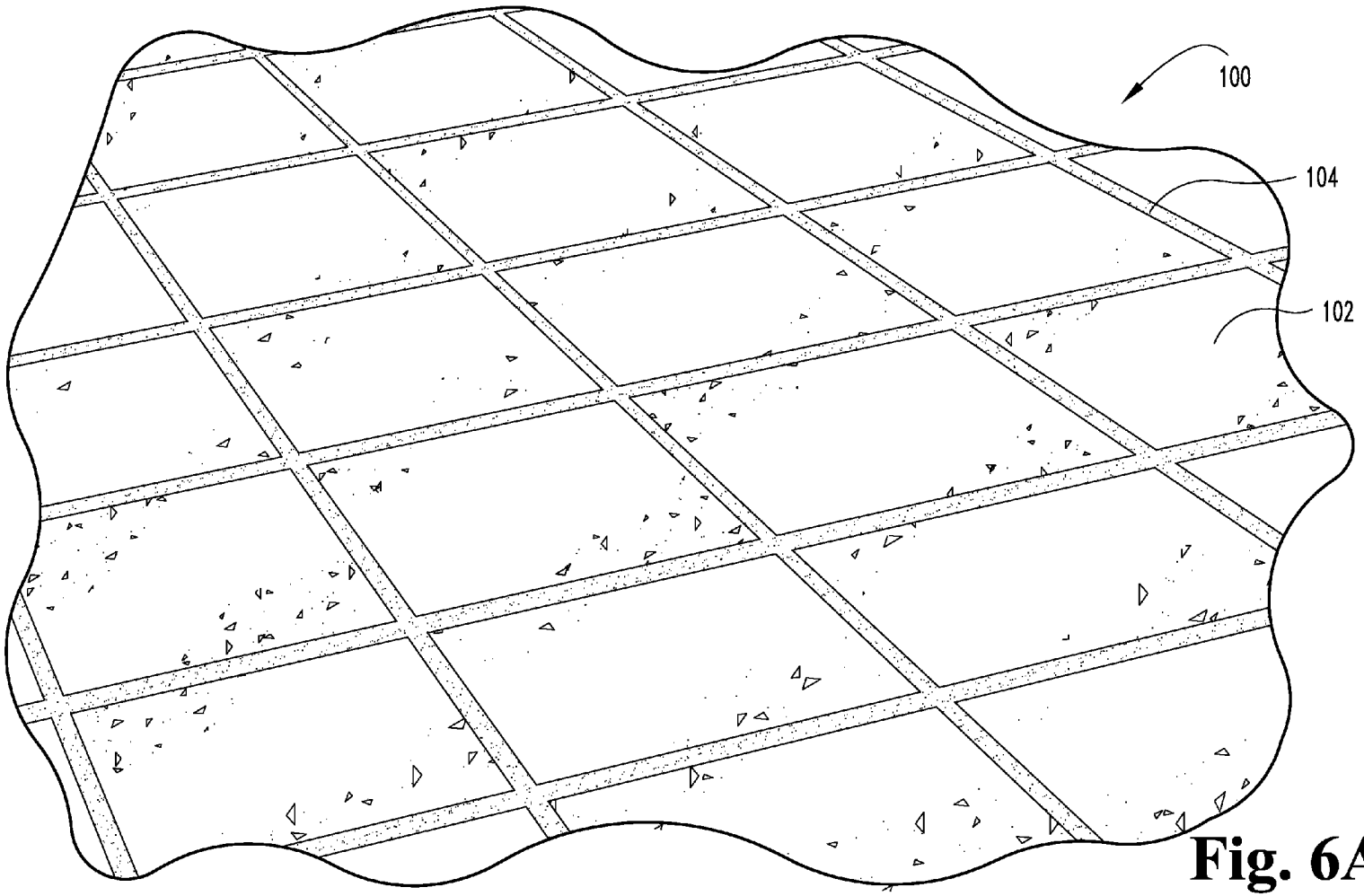
FIG. 6A is a first perspective view of an epoxy porcelain floor according to a second embodiment of the present novel technology.
Figure 6B:
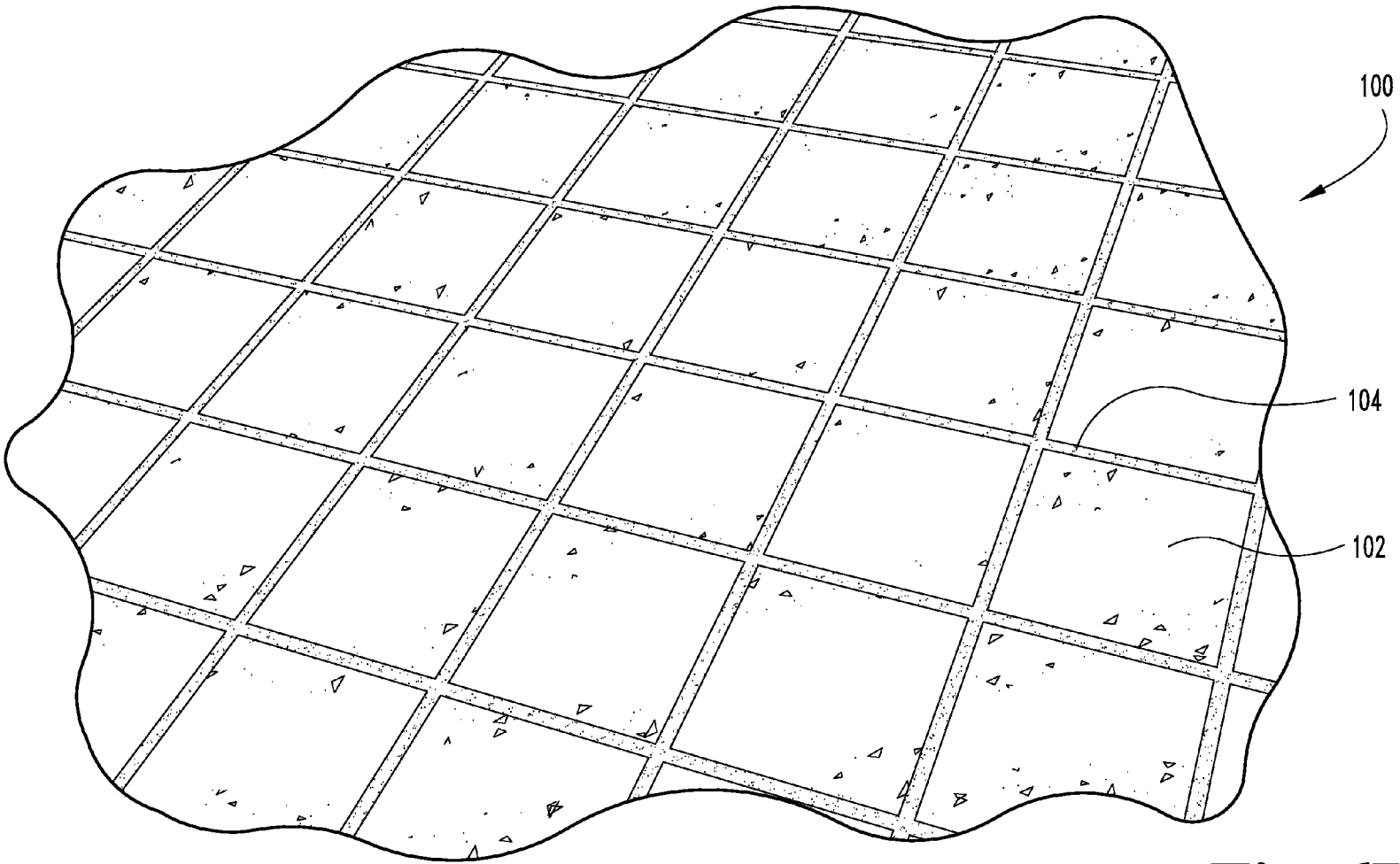
FIG. 6B is a second perspective view of FIG. 6A.

Novel Terrazzo Surface Finishing Technique:

As illustrated in FIGS. 3-5J, a first embodiment of the present novel technology relates to a multi-step method for finishing epoxy terrazzo surfaces. Specifically, as illustrated in FIG. 5A, a circular drive board 18 having a very high density foam layer 20 (or, alternately, no foam layer at all) is fitted with a typically coarse grit, more typically metal-bonded, circular diamond polishing discs 22 respectively at the equidistant positions (such as a the 12, 4, and 8 o'clock positions) around the drive board 18. The polishing discs 22 are typically about 3 inches wide and are typically positioned slightly inwardly, such as about ¼ inch inward, from the drive board edges 24. The polishing discs 22 typically include diamond abrasive media 26, and the diamond abrasive media size is more typically about 60-grit as is typically intended and sold for use with granite, not marble; however, as used herein the 60-grit MBG diamond abrasive media 26 are successfully used to grind and polish softer marble terrazzo surfaces. The drive board 18 is typically made of sufficiently rigid material so as not to cup during polishing.

A relatively light amount of pressure is applied (such as 160-180 pounds, as opposed to a typical grinding pressure of about 500 pounds applied with finer grit size grinding media) to the 60-grit grinding media 26. Specifically, the drive board 18 is connected to a relatively light weight rotary polishing machine 28, such as the Eco Labs' STONE MEDIC Mighty Max, and run at a medium to slow speed, such as between about 175 and 225 rpm (see FIG. 5B). The machine 28 will have a tendency to heel to the right (or left, if the board rotates in a counter-clockwise direction) and will typically be weighted to enhance the heel, rather than conventionally weighted to counter-balance the heel, thus creating an enhanced heel quadrant that does most of the work. (STONE MEDIC is a registered trademark of Ecolab Inc. Corp., 370 Wabasha Street N. ESC/F7 St. Paul, Minn., 55102, reg. no. 76201946). Enhancing the heel of the polisher 28 gives rise to the effect of the diamond abrasive media 26 striking the marble chips 31 and cementitious or epoxy binder portions 33 of the terrazzo surface 10 at a shallow angle, such that the diamond abrasive media 26 strike and cut or shave 35 the surface with a proportionally larger shearing force 37, rather than a more perpendicularly applied force 39, as is typically characteristic of grinding. This results in a surface 10 having marble chips 31 and epoxy matrix 33 material removed at substantially the same rate to yield a surface 10 having chips 31 and matrix material 33 substantially more flush than is typically the case with grinding. With traditional grinding forces applied, the surface is ground down with greater substantially perpendicular forces 39, which urge the abrasive media 26 to plow through the workpiece, preferentially removing the softer matrix material 33 (this preferential removal of the matrix material 33 results in a less attractive surface 10 that must be repolished much more frequently, such as every 3 or 4 months instead of annually). For the first polishing step 40, the work surface 10 is typically treated with 2-4 passes, until the resistance has palpably decreased, giving the operator the feedback that the diamond abrasive media 26 are no longer doing substantial work. In other words, it is the number of passes with the rotating grinding media 26 that do the grinding work, not the amount of pressure applied to the grinding media 26, and in fact excess downward force 39 applied to the grinding media 26 moves the system out of optimization and retards the grinding process by preferentially attacking the matrix material 33.

The second step 42 is similar to the first 40, but with the 60-grit abrasive tool discs 22 replaced with 150-grit diamond abrasive tool discs 22. Additionally, the heel of the polishing machine 28 is typically progressively decreased as the diamond abrasive grit size decreases, such as by partially removing some of the heeling weight 32 previously added or by shifting the heeling weight distribution. During this step, the work surface 10 is smoothed to an even finer, more leveled finish. As with the first step 40, the work surface is typically treated with 2-4 passes, utilizing the right front heel quadrant 30 of the machine 28 and any given portion of the work surface 10 is treated until the machine resistance has palpably decreased, giving the operator the feedback that the diamond abrasive media 26 are no longer doing substantial work.

The third step 44 is similar to the first two 40, 42 as detailed above, but with half-discs 34 of 150-grit diamond media 26 in a more flexible bond system, such as RVG media in a resin or vitreous bond, and connected to the board 18 at the outer edges 24 (again, typically in an equidistant orientation, such as at the 12, 4, and 8 o'clock positions). The half-discs 34 typically have a 5 inch diameter (were they full discs). The surface 10 is again typically fully treated with 2-4 passes.

The fourth step 46 is substantially identical to the third 44, but for the replacement of the 150-grit diamond grinding media half-discs 22 with 300-grit diamond media half-discs 34. The fifth step 48 is again substantially similar to the third and fourth steps 44, 46 as detailed above, but with half-discs 36 of 400-grit resin-bonded diamond media 26. These diamonds 26 are typically more brittle than the previously-used metal bonded system abrasives 26 (either with substantially more built-in impurities or by being polycrystalline in nature) and fracture/expose much more quickly and are characterized by sharp fracture edges. Two passes are typically sufficient to polish the floor 10 to the ability of 400-grit media 26, but more may be made if the machine resistance has not sufficiently decreased.

The sixth step 50 is substantially similar to the fifth 48, but with half-discs 36 of 800-grit resin bonded diamond media 26. By this point, the heeling weights 32 are typically completely removed from the polishing machine 28. After completion of the sixth grinding/polishing step 50, the work surface 10 is substantially smooth, but for the porosity inherent in the marble chips 31 and (if selected) cementations binder 33. The seventh step 52 is the application of a heavy coat of vitrification chemical 54. The epoxy is then allowed to sit and cure for 4-6 months. The vitrification chemical 54 is typically applied simultaneously with a buff 56 using a steel wool pad 58. The vitrification chemical 54 is typically a magnesium fluoride compound which reacts with the calcium carbonate of the marble to form calcium fluoride to seal the porosity of the surface 10. The eighth and typically final step 60 is a repeat of the sixth and seventh steps 50, 52 on the cured surface 10, resulting in a highly polished, visually attractive and substantially non-porous surface 70. If desired, the vitrification chemical 54 may be applied as multiple coats, each application of which is typically followed by an 800-grit polish 50 and/or steel wool buffing 56.

In one alternate embodiment, the work surface 100 is comprised of porcelain tiles and/or tile fragments or pieces set 102 in a cement or like base and having an epoxy resin binder matrix material filling in the void space between the porcelain tiles and/or pieces 104. Typically, the porcelain tiles 102 are patterned into a floor or surface 100 and bonded with mortar, cement or a like binder 104. Any necessary expansion joints or divider strips (not shown) are typically caulk points, but may also be made of zinc or the like for a more specifically tailored appearance. Such joints and/or dividers are typically about ⅛ inch in width. For expansion joints, a pair of adjacently positioned spaced strips may be used, typically spaced about ⅛ inch apart. Spaces between the tiles 102 are maintained free of the mortar or cementitious binder, and any excess mortar and/or cementitious binder is removed from therebetween once the tiles have been set and bonded.

After the tiles 102 have been set and the bonding material has cured, epoxy resin 104, such as TERROXY, is prepared in one or more desired colors and grouted into the open lines and spaces between the tiles, joints and dividers (TERROXY is a registered trademark of the Terrazzo & Marble Supply Co. of Illinois, an Illinois Corporation located at 77 South Wheeling Road, Wheeling, Ill., 60090). Further, sufficient epoxy resin 104 is applied to completely cover each respective tile 102. The epoxy resin 104 is allowed to substantially cure, a process that typically takes from about 40 to about 70 hours.

Once the epoxy resin layer 104 has substantially cured, the surface 100 is ground and polished as described above regarding at least steps 1 through 5 of the first embodiment, and more typically with precursor steps including a preliminary surface leveling shaving step, similar to step 1 above but with coarser metal bonded diamond abrasive media, such as 24- to 36-grit, and a fully weighted polishing machine to maximize its heel so as to yield a tile surface that has been substantially leveled prior to the application of the finer grit sequence of shaving steps (1-5 as described above). A 400-grit finish is typically sufficient for producing a porcelain tile surface with a smooth, attractive finish while leaving enough surface topography to provide sufficient traction to one walking thereupon. If desired, step six may be undertaken to yield a surface with an even smoother finish. As porcelain tile 102 is substantially non-porous, step seven, the sealing step, is unnecessary and typically not performed. Once polished to the appropriate finish, the tile surface 100 is typically maintained by mopping with a detergent solution.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A method of preparing an epoxy grouted porcelain tile surface, comprising:

a) providing an epoxy grouted porcelain tile surface, wherein the epoxy grouted porcelain tile surface further comprises a plurality of porcelain tiles spaced apart by epoxy resin grouting;

b) attaching MBG-type diamond grit abrasive media to a polishing disc, wherein the abrasive media are characterized by a relatively coarse grain size;

c) attaching the polishing disc to a lightweight polishing machine;

d) weighting the polishing machine to enhance the inherent heel; and e) shaving the epoxy grouted porcelain tile surface with the relatively coarse grain size MBG-type diamond grit abrasive media to yield a substantially flat surface;

f) replacing the relatively coarse grain size MBG-type diamond grit abrasive media with relatively fine grain size MBG-type diamond grit abrasive;

g) shaving the epoxy-matrix terrazzo surface with the relatively fine grain size MBG-type diamond grit abrasive media;

h) replacing the relatively fine grain size MBG-type diamond grit abrasive media with relatively coarse grain size RVG-type diamond grit abrasive media; and i) shaving the epoxy-matrix terrazzo surface with the relatively coarse grain size RVG-type diamond grit abrasive media;

wherein the relatively coarse grain size RVG-type diamond grit is at least as small as the relatively fine grain size MBG-type diamond grit.

2. The method of claim 1 and further comprising:

j) replacing the relatively coarse grain size RVG-type diamond grit abrasive media with relatively fine grain size RVG-type diamond grit abrasive; and k) shaving the epoxy-matrix terrazzo surface with the relatively fine grain size RVG-type diamond grit abrasive media to yield a substantially smooth shaved surface;

wherein the substantially smooth shaved surface is characterized by porcelain tiles substantially flush with epoxy resin grouting material.

3. A method of for polishing an epoxy porcelain surface, comprising:

a) identifying an epoxy porcelain surface characterized by porcelain aggregate pieces in an epoxy matrix; and b) shaving the epoxy porcelain surface with a plurality of diamond abrasive particles to yield a substantially flat surface characterized by plurality of porcelain tiles substantially flush with an epoxy matrix;

wherein the diamond abrasive particles are MBG-type mesh crystals; and wherein the diamond abrasive particles substantially laterally impact surface protrusions to shave them off;

wherein step b) further includes the substeps of:

b1) shaving the epoxy porcelain surface with a first plurality of first diamond abrasive particles;

b2) shaving the epoxy porcelain surface with a second plurality of second diamond abrasive particles; and b3) polishing the epoxy porcelain surface with a third plurality of third diamond abrasive particles;

wherein the first diamond abrasive particles are MBG-type mesh crystals characterized by a first average size;

wherein the second diamond abrasive particles are MBG-type mesh crystals characterized by a second average size smaller than the first average size;

wherein the third diamond abrasive particles are characterized by a third average size smaller than the second average size; and wherein the third diamond abrasive particles are more friable than the second diamond abrasive particles.

4. A method for polishing an epoxy porcelain surface, comprising:

a) identifying an epoxy porcelain surface characterized by porcelain aggregate pieces in an epoxy matrix; and b) shaving the epoxy porcelain surface with a plurality of diamond abrasive particles to yield a substantially flat surface characterized by plurality of porcelain tiles substantially flush with an epoxy matrix;

wherein the diamond abrasive particles are MBG-type mesh crystals; and wherein the diamond abrasive particles substantially laterally impact surface protrusions to shave them off;

wherein step b) further includes the substeps of:

b1) shaving the epoxy porcelain surface with a first plurality of substantially 60-grit single crystal diamond abrasive particles;

b2) shaving the epoxy porcelain surface with a second plurality of substantially 150-grit single crystal diamond abrasive particles; and b3) polishing the epoxy porcelain surface with a third plurality of substantially 400-grit polycrystalline diamond abrasive particles.

5. A method of polishing a porcelain terrazzo floor, comprising:

a) providing a plurality of generally flat, spaced porcelain tiles and an epoxy resin binder material positioned between respective spaced tiles to define a porcelain terrazzo floor;

b) shaving the porcelain terrazzo floor with a first plurality of first diamond abrasive particles;

c) shaving the porcelain terrazzo floor with a second plurality of second diamond abrasive particles; and d) polishing the porcelain terrazzo floor with a third plurality of third diamond abrasive particles;

wherein the first diamond abrasive particles are MBG-type mesh crystals characterized by a first average size;

wherein the second diamond abrasive particles are MBG-type mesh crystals characterized by a second average size smaller than the first average size;

wherein the third diamond abrasive particles are characterized by a third average size smaller than the second average size;

wherein the third diamond abrasive particles are more friable than the second diamond abrasive particles; and wherein the diamond abrasive particles substantially laterally impact surface protrusions.

6. The method of claim 5 wherein the first diamond particles are substantially 60-grit MBG crystals; wherein the second diamond particles are substantially 150-grit MBG crystals; and wherein the third diamond particles are substantially 400-grit RVG diamond crystals.

7. The method of claim 5 and further comprising:

e) polishing the porcelain terrazzo floor with a fourth plurality of fourth diamond abrasive particles;

wherein the fourth diamond abrasive particles are characterized by a fourth average size smaller than the third average size; and wherein the fourth diamond abrasive particles are more friable than the second diamond abrasive particles.

8. The method of claim 5 wherein the first diamond particles are substantially 60-grit MBG crystals; wherein the second diamond particles are substantially 150-grit MBG crystals; wherein the third diamond particles are substantially 150-grit RVG diamond crystals; and wherein the fourth diamond particles are substantially 400-grit RVG diamond crystals.

* * * * *